US005287945A

United States Patent [19]

Thurlow

[11] Patent Number: 5,287,945

[45] Date of Patent: Feb. 22, 1994

[54] LADDER FOR BOARDING INFLATABLE BOATS

[76] Inventor: Mark Thurlow, 173 Copper Ave., Vista, Calif. 92083

[21] Appl. No.: 986,611

[22] Filed: Dec. 7, 1992

[51] Int. Cl.[5] ..... E06C 5/26

[52] U.S. Cl. ..... 182/97; 182/86; 182/100; 182/93; 114/362

[58] Field of Search ..... 182/93, 97, 91, 90, 182/100, 189, 194, 86; 114/362

[56] References Cited

U.S. PATENT DOCUMENTS

| | | | |
|---|---|---|---|
| 3,869,742 | 3/1975 | Gale et al. | 114/362 |
| 4,186,820 | 2/1980 | Cosman et al. | 182/93 |
| 4,541,507 | 9/1985 | Gibellato | 182/86 |
| 4,572,330 | 2/1986 | Langevin | 182/206 |
| 5,113,782 | 5/1992 | McCarty | 182/93 X |

*Primary Examiner*—Alvin C. Chin-Shue
*Attorney, Agent, or Firm*—Lewis E. Massie

[57] ABSTRACT

An inflatable boat boarding ladder, adaptable to any size inflatable boat, for assisting divers to exit the water and to board the boat. The ladder, supported at an outside angle to the vertical, is prohibited from rotating under the boat when the ladder is engaged by the users foot thus providing greater stability than the conventional rope style ladders. The instant invention provides a longer ladder than the conventional ladders making it easier to use. The ladder is supported by a flexible saddle made of a sandwhich of two layers of HYPALON encasing reinforcing transverse plattens pf ABS plastic.

1 Claim, 1 Drawing Sheet

LADDER FOR BOARDING INFLATABLE BOATS

BACKGROUND OF THE INVENTION

1. Field of the Invention

The present inventionn relates to ladders for boarding inflatable boats. More specifically it relates to ladders for assisting divers in exiting the water and entering the boat.

2.Description of the Related Art

A wide variety of boarding ladders specifically designed for boarding small boats are known in the related art. U.S. Pat. No. 4,572,330 issued to Langevin in Feb. 1986 discloses a boat ladder for boarding an inflatable pontoon boat, dinghy, or similar small craft having opposed generally parallel gunwales. The ladder has two generally parallel ladder supports, each with a first end bendable across on of the gunwales. Plural and parallel ladder steps extend betwwen the two ladder supports and a strap is coupled at one end to the first end of both ladder supports. U.S. Pat. No. 4,186,820 issued to Cosman et al in February 1980 discloses a boarding ladder for use in conjunction with an inflatable boat having an inflatable side pontoon and specifically, to an improved boarding ladder including a strap assembly for mounting the ladder to the inflatable boat.

SUMMARY OF THE INVENTION

The boarding ladder as described in the present invention can be mounted on an inflatable boat of any size. The ladder is stable and of sufficient length to facilitate entry into the boat from the water. Improvements incorporated into the instant invention overcome problems encountered with currently available ladders are: lack of stability, the ladder rotates under the boat as it is stepped on, or the ladder is too short for use by divers.

The present invention is configured as a saddle constructed from HYPALON, or the like, fabric reinforced by transverse battens of ABS plastic, or the like. The saddle can fit over any size inflatable gunwale. On the outside of the saddle, attached to the last batten, is the ladder mount. The ladder is constructed from a single pole with two rungs. The sides of the rungs are left open to facilitate the ladders use by divers wearing fins. The ladder it attached to the mount by a longitudimal pin permitting the ladder to rotate upwardly when the boat is under way and downwardly when the ladder is deployed for use. A stop is incorporated within the mount to support the ladder, when it is down, 20 degrees outwardly from the vertical. This outward angle in neccessary as when weight is applied to the ladder the boat hull is partially compressed by the saddle allowing the ladder to assume a more vertical position. Two orifices through the saddle along the top edge provide access for ropes to tie the saddle to the boat. On the out side surface of the saddle is a rope handle is fastened to the saddle to assist entry into the boat from the ladder.

DETAILED DESCRIPTION OF THE PREFERRED EMBODIMENT

Figure 1:
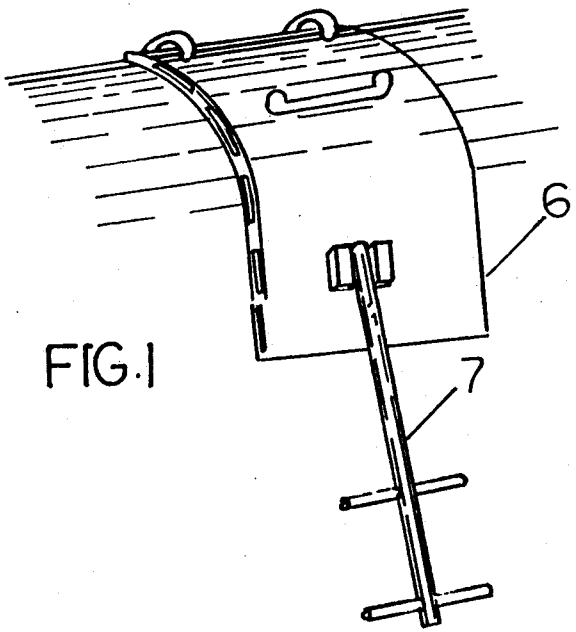
FIG. 1 is perspective view of the ladder attached to the curved gunwales of an inflatable boat.
Figure 3:
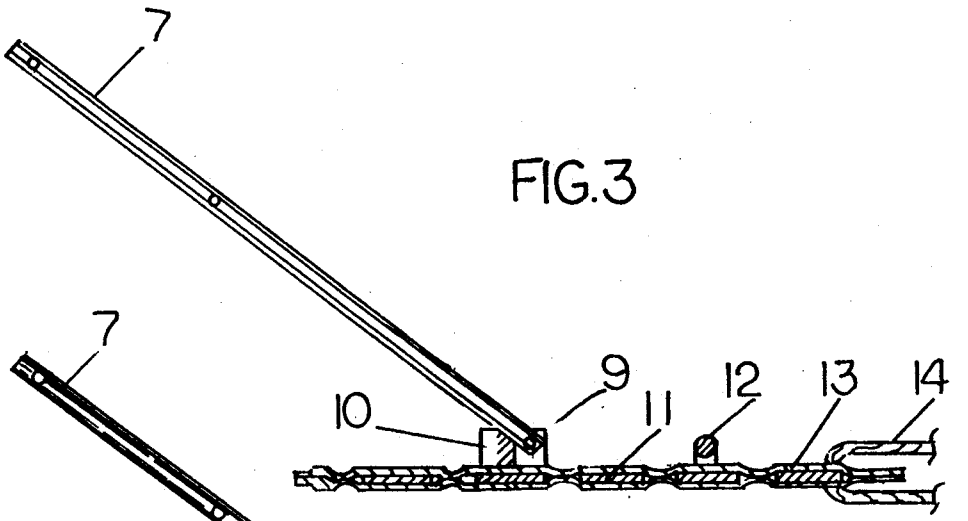
FIG. 3 is a sectional view through 2—2 of FIG. 1.
Figure 4:
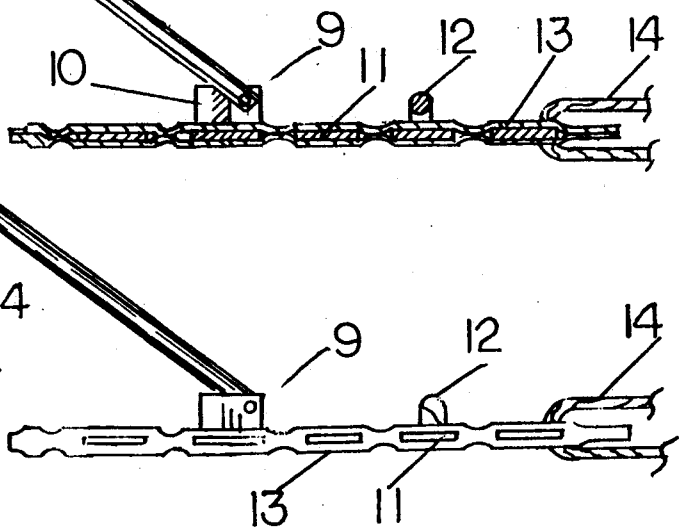
FIG. 4 is right side elevation of the ladder assembly.
Figure 2:
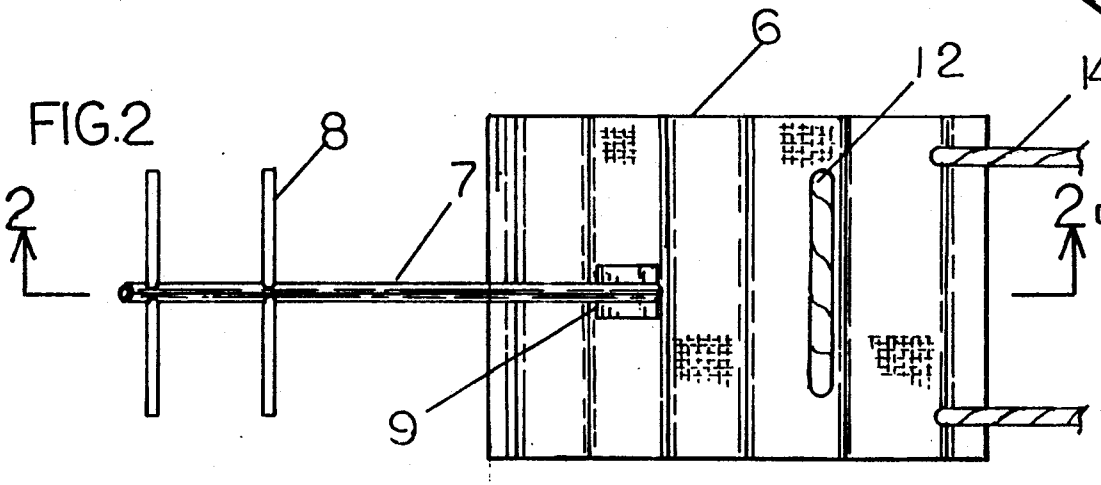
FIG. 2 is a front elevation of the ladder assembly.

Referring to FIG. 1 the ladder assembly is shown with the saddle 6 mounted on the arcuate gunwales of an inflatable boat. FIG. 2 shows a planview of the ladder assembly in which the saddle 6 has the centrally located hingeed ladder mounting 9 rotatably supporting the tubular ladder support 7, with the tubular rungs 8, the boarding assist rope 12 and the ladder attachment ropes 14. In the sectional view of the ladder assembly as shown in FIG. 3, the tubular ladder support 7 is fastened to the mounting block and restricted from being horizontal by the stop 10. The laminated construction of the saddle 6 is shown with the transverse plattens 11 of ABC plastic between the covering layers of HYPALON 13. FIG. 4 is a side elevation of the ladder assembly the other side being a mirror image thereof.

I claim:

1. A flexible saddle with an attached ladder for boarding inflatable boats wherein the improvements comprise:

(a), a saddle comprising a planer upper layer and a lower layer of HYPALON, or the like, encasing transverse platens of ABC, or the like, plastic; p1

(b), the transverse platens with a width of approximately three inches and a thickness of one quarter inch except for the platen which supports a centrally located hinged mounting block.

(c), the ladder consisting of an elongated tube of non-corrosive material with two spaced tubular rungs at the bottom portion;

(d), the ladder fastened to the hinged mounting block to be rotational in a longitudinal plane of the saddle;

(e), said mounting block centrally located and fastened to the platen;

(f), the hinged mounting block incorporating a stop to maintain the ladder outwardly 20 degrees from vertical;

(g), a handle, comprising a loop of rope, or the like, fastened to the saddle above the hinged mount;

(h), two orifices centrally located along a top edge of the saddle for fasteneing the saddle to the boat by means of cords or belts.

* * * * *